US006086519A

United States Patent [19]

Ayton

[11] Patent Number: 6,086,519

[45] Date of Patent: Jul. 11, 2000

[54] METHODS AND APPARATUS FOR SUPPORTING A BARBELL

[76] Inventor: W. Brooke Ayton, 12203 Meadow Park Ct., Meadows, Tex. 77477

[21] Appl. No.: 09/240,077

[22] Filed: Jan. 29, 1999

[51] Int. Cl.[7] ..... A63B 21/078

[52] U.S. Cl. ..... 482/104

[58] Field of Search ..... 402/104; D21/675–676

[56] References Cited

PUBLICATIONS

Kolbel Trainings for Schung Magazin pp. 132–133, Dec. 1983.

*Primary Examiner*—John Mulcahy

*Attorney, Agent, or Firm*—Mau & Krull, P.A.

[57] ABSTRACT

An otherwise conventional exercise apparatus is improved by mounting left and right barbell supports on outward sides of left and right frame members. The supports engage the barbell both outward from and forward of the frame members such that gaps are created between the barbell and the posts sufficient to accommodate a user's hands. This reduces the likelihood that a user will pinch their hand between the barbell and post and allows the user to assume a relatively wider grip on the barbell for a given size apparatus.

12 Claims, 2 Drawing Sheets

METHODS AND APPARATUS FOR SUPPORTING A BARBELL

FIELD OF THE INVENTION

The present invention relates to exercise equipment and especially to exercise equipment that supports a barbell or other load bearing bar for movement by a user.

BACKGROUND OF THE INVENTION

Many types and variations of exercise equipment are known in the art. On certain strength training equipment, a bar is selectively supported at a rest position and available for movement to a discrete position for exercise purposes. In the case of barbells, for example, an equal amount of weight is typically mounted on each end of a bar to resist movement of the bar away from the floor. Equipment is available to support the barbell and/or to allow the person using the barbell to position himself relative to the bar and/or to provide a counteracting force during movement of the bar.

For purposes of discussion, one particular prior art apparatus, suitable for bench press exercises, is depicted in FIGS. 4–6. The bench press apparatus 8 includes a frame 10 which is designed to rest upon a floor surface 90, and which extends longitudinally from a first end 12, typically associated with a person's feet, to a second end 14, typically associated with a person's head. A padded support 16 extends between the ends 12 and 14 and is provided to support a person's torso. Left and right frame members or posts 18 extend perpendicularly upward from the floor surface 90 proximate the end 14 of the frame 10. A top bracket 22 is mounted on top of each post 18 to provide a means for supporting a barbell 99. Additional brackets 22 are rigidly mounted to discrete, intermediate portions of each post 18 to provide alternative locations to rest the barbell 99. Typically, the brackets 22 and 24 are made of steel and secured to the steel posts 18 by welding.

Although the bench 8 satisfactorily performs its intended purpose, it is believed that room for improvements exists, particularly with respect to the manner in which the barbell 99 is supported on the posts 18. It is also believed that room for similar improvements exists with respect to other types of equipment that support load bearing bars, including (without limitation) shoulder press machines, decline press machines, incline press machines, squat racks, arm curl machines, and the like.

SUMMARY OF THE INVENTION

The present invention provides barbell supports or brackets which are preferably made from integral blocks of plastic. Each of the brackets includes several shoulders or support locations for accommodating a barbell. A pair of the brackets may be secured to an otherwise conventional weight bench in such a manner that the barbell is supported both outside and forward of the posts.

As compared to the prior art bench 8, for example, the present invention provides several advantages, including the following: (a) the posts are protected against wear and tear, such as scratching, because the barbell rests against the forward edges of the brackets, rather than the forward edges of the posts; (b) the brackets reduce noise associated with exercise, because the barbell is returned to a rest position against plastic brackets, rather than metal posts; (c) a user is less likely to pinch his hand between the barbell and a post, because the brackets support the barbell forward of the posts; (d) for the same size bench, the user may assume a wider grip on the barbell, because the brackets support the barbell at relatively more outward positions than the posts; (e) the brackets eliminate manufacturing time and quality concerns associated with prior art brackets that are welded in place on the posts; (f) the brackets may be removed and/or replaced with little inconvenience and only very basic tools; (g) a single bracket may be designed with any number of barbell supports, without requiring a discrete mounting process for each of the supports; and (h) the brackets are well suited for industrial design and/or for bearing information regarding the bench and/or the manufacturer of the bench. Additional features and/or advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 6:
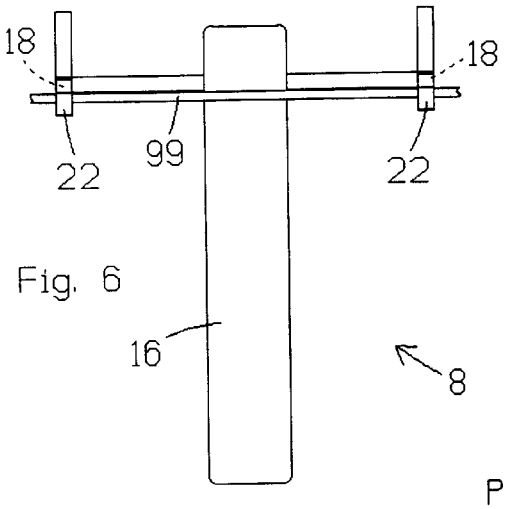
Fig. 6 Prior Art
FIG. 6 is a top view of the prior art weight bench of FIG. 4.
Figure 5:
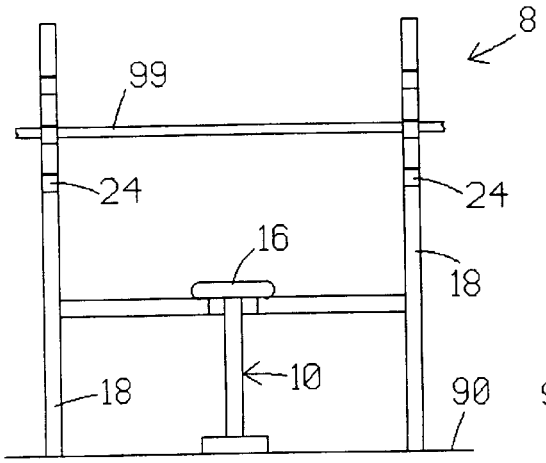
FIG. 5 is a front view of the prior art weight bench of FIG. 4.

The present invention provides methods and apparatus which facilitate exercise involving movement of a barbell or other load bearing bar. The present invention is described with reference to a preferred embodiment weight bench designated as 100 in FIGS. 1–3. In many respects, the weight bench 100 is similar to the prior art weight bench which is designated as 8 in FIGS. 4–6. The prior art weight bench 8 is disclosed herein to help provide context for understanding the advantages of the present invention. This direct comparison of old and new designs also demonstrates that the present invention may be readily applied to existing products. It is also to be understood that the present invention is applicable to a variety of exercise machines and not just one particular bench or type of exercise equipment.

As discussed above and shown in FIGS. 4–6, the prior art bench 8 includes a frame 10 designed to rest upon a floor surface 90. The frame 10 extends longitudinally between a first end 12, typically associated with a person's feet, and a second end 14, typically associated with a person's head. A padded support 16 extends between the ends 12 and 14 and is typically used to support a person's back. Left and right frame members or posts 18 extend upward from the floor surface 90 proximate the end 14 of the frame 10. A top bracket 22 is mounted on top of each post 18 to provide a means for supporting a barbell 99. Additional brackets 22 are welded to discrete, intermediate portions of each post 18 to provide alternative locations to rest the barbell 99.

Figure 3:
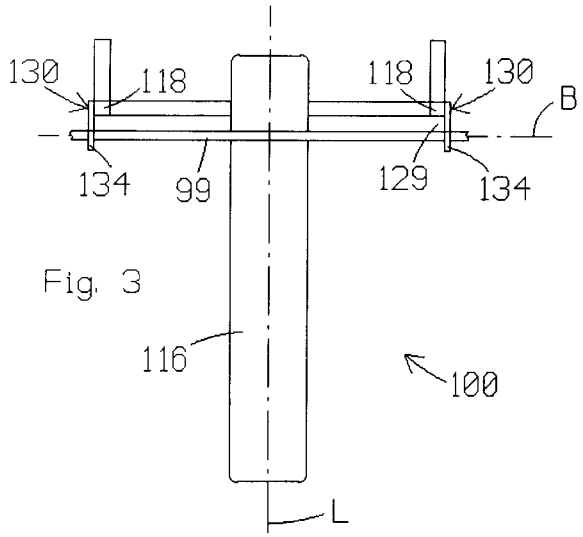
FIG. 3 is a top view of the weight bench of FIG. 1.
Figure 2:
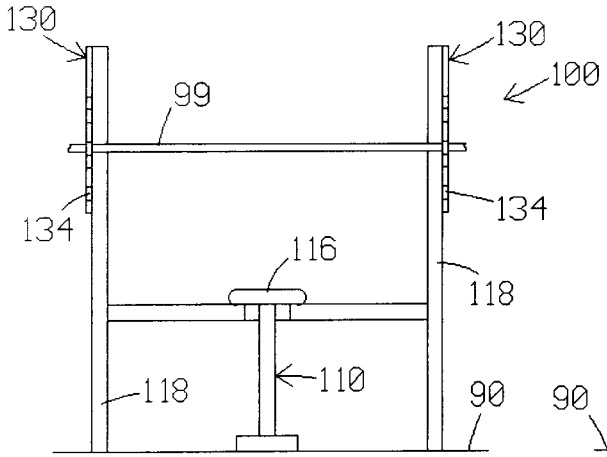
FIG. 2 is a front view of the weight bench of FIG. 1.
Figure 1:
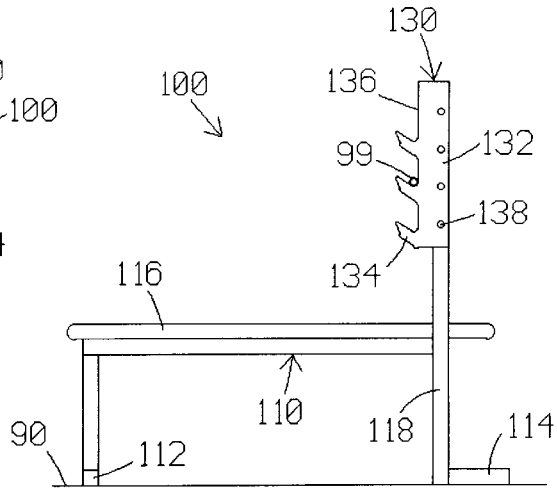
FIG. 1 is a side view of a weight bench constructed according to the principles of the present invention.
Figure 4:
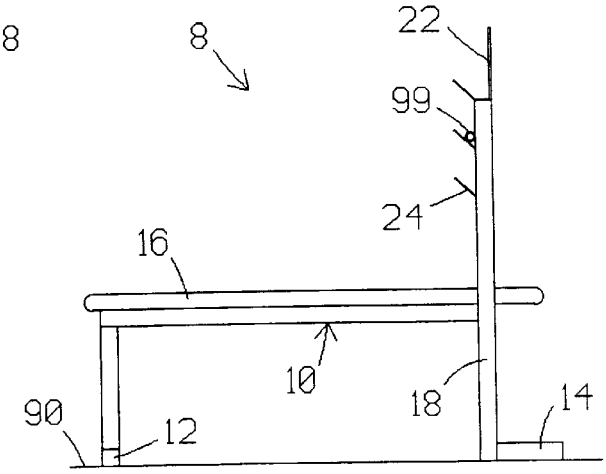
FIG. 4 is a side view of a prior art weight bench.

As shown in FIGS. 1–3, the preferred embodiment bench 100 similarly includes a frame 110 designed to rest upon a floor surface 90. The frame 110 extends longitudinally from a first end 112, typically associated with a person's feet, to a second end 114, typically associated with a person's head. A padded support 116 extends between the ends 112 and 114 and is typically used to support a person's back. Left and right frame members or posts 118 extend perpendicular upward from the floor surface 90 proximate the end 114 of the frame 110. To this extent, the preferred embodiment 100 is identical to the prior art bench 8, except that the posts 118 are somewhat longer.

Novel support brackets 130 are secured to the upper ends of respective posts 118 by means of bolts 138. Each support bracket 130 is cut from a block of plastic, preferably ultra-high molecular weight plastic (UHMW) or high density polyethylene (HDPE). Each bracket 130 includes a base portion or main body 132 and several shoulder portions 134 which project outward from the base portion 132. Each shoulder portion 134 is sized and configured to support an end of a barbell 99 and any weights (not shown) connected to that end of the barbell 99. An upper distal edge or forward edge 136 of the base portion 132 helps guide the barbell 99 into alignment with the uppermost shoulder portion 134.

Each base portion 132 defines a bracket height which is measured perpendicular to the floor surface; a bracket thickness which is measured parallel to the longitudinal axis B of the barbell 99 (see FIG. 3); and a bracket width which is measured perpendicular to the bracket height and the bracket thickness. On the preferred embodiment 100, the bracket height is approximately two feet; the bracket thickness is one and one-quarter inches; and the bracket width is approximately six inches. Each shoulder portion 134 projects approximately two and one-half inches outward from a respective base portion 132, as measured in a direction parallel to the bracket width. Each shoulder portion 134 provides an upwardly facing ledge which is angled toward the forward edge 136 to discourage the barbell 99 from inadvertently rolling off the brackets 130.

Each post 118 is a square tube made of steel and having a cross-section which measures three inches by three inches. The brackets 130 are secured to outward sides of respective posts 118, and the rearward edge of each base portion 132 is flush with the rearward edge of a respective post 118. In other words, the brackets 130 are spaced three inches farther apart from the longitudinal axis L of the bench 100 than the posts 118, and the forward edges 136 of the brackets 130 are spaced three inches forward of the forward edges of the posts 118. An advantage of this arrangement is that the barbell 99 rests against the leading edges 136 of the brackets 130, rather than the leading edges of the posts 118, thereby protecting the posts 118 against wear and tear, such as scratching. This arrangement also reduces noise when the barbell 99 is returned to a rest position against plastic rather than metal. Yet another advantage of this arrangement is that gaps 129, which measure three inches by three inches, are created between the barbell 99 and the posts 118 (see FIG. 3). Each gap 129 reduces the likelihood that a user will pinch his hand between the barbell 99 and a respective post 118 and/or allows a user to assume a relatively wider grip on the barbell 99 for a given size bench 100.

The present invention is beneficial in other respects, as well. For example, the brackets 130 eliminate manufacturing time and quality concerns associated with welding prior art brackets 22 and 24 into place (see FIGS. 4–6). Also, in the event that removal and/or replacement of a bracket 130 is warranted, it is a relatively simple task which involves only very basic tools. Moreover, a single bracket 130 may be designed with any number of desired supports 134, without requiring a discrete mounting process for each support. The brackets 130 are also well suited for industrial design and/or for bearing information regarding the bench 100 and/or the manufacturer of the bench 100.

Apart from the bench 100, the present invention may also be described in terms of a support bracket in combination with a barbell and an exercise apparatus of the type having a support post. Within this context, the bracket may be said to comprise a block of plastic having a bracket height which is measured parallel to the support post, a bracket thickness which is measured parallel to the barbell, and a bracket width which is measured perpendicular to the bracket height and the bracket thickness. Shoulders project outward from the block of plastic in a direction parallel to the bracket width. The support post has a post thickness which is measured parallel to the bracket thickness and is greater than the bracket thickness, and a post width which is measured parallel to the bracket width and is less than the bracket width. Holes extend through the block of plastic to facilitate mounting to the support post.

Those skilled in the art will also recognize that the foregoing description provides context for describing the present invention in terms of various methods. For example, the present invention may be said to provide a method of modifying otherwise conventional exercise equipment of the type having bar supporting frame members. One such method involves mounting left and right brackets on the oppositely facing sides of respective frame members in such a manner that shoulders on the brackets engage a load bearing bar at locations which are spaced apart from respective frame members and spaced apart from one another to a greater extend than the frame members.

The foregoing description and accompanying figures disclose only some of the embodiments and/or applications of the present invention. Recognizing that this disclosure will lead those skilled in the art to pursue additional embodiments and/or variations, the scope of the present invention should not be limited to the specifics of the disclosure, but rather, should be limited only to the extent of the following claims.

What is claimed is:

1. A weight bench exercise apparatus, comprising:

first and second rigid frame members having respective inward facing sides which face toward one another, respective outward facing sides which face away from one another and define a frame span therebetween, respective forward facing sides which face in a common direction and extend perpendicular to the inward facing sides and the outward facing sides, and respective rearward facing sides which face away from the forward facing sides;

a bench supported between the two frame members; and first and second offset brackets mounted on the outward facing sides of respective frame members, wherein said brackets provide respective bearing surfaces which extend parallel to the forward facing sides and are disposed at a distance forward of the forward facing sides to create a gap sufficient to accommodate a user's hands between the forward facing sides of the frame members and a barbell supported by said bearing surfaces, and said brackets cooperate to provide aligned pairs of ledges which extend forward from respective bearing surfaces and are sized and configured to underlie discrete portions of a barbell outside the frame span.

2. The apparatus of claim 1, wherein the frame members are made of steel, and the offset brackets are blocks of plastic.

3. The apparatus of claim 1, wherein the offset brackets are bolted to the frame members.

4. The apparatus of claim 1, wherein said brackets provide respective bearing surfaces which are disposed three inches forward of the forward facing sides.

5. A method of improving an otherwise conventional exercise apparatus of the type having left and right posts, to allow a person to grip respective portions of a barbell disposed directly in front of the posts, comprising the steps of:

forming first and second blocks of plastic into left and right support brackets having leading edges, and shoulders which protrude from respective leading edges; and mounting the brackets on opposite facing sides of respective posts in such a manner that the brackets are further apart than the posts, and the shoulders on the left bracket are aligned with the shoulders on the right bracket, and the leading edges are spaced at a distance forward of respective posts to create a gap sufficient to accommodate a user's hands between the front of the posts and a barbell supported by the leading edges.

6. The method of claim 5, wherein the forming step involves cutting the brackets from solid blocks of plastic.

7. The method of claim 5, wherein the mounting step involves bolting the brackets to respective posts.

8. The method of claim 5, wherein the brackets are mounted on opposite facing sides of respective posts in such a manner that the leading edges are spaced three inches forward of respective posts.

9. A method of supporting a barbell on exercise equipment of the type having left and right support members, to allow a person to grip respective portions of a barbell disposed directly in front of the support members, comprising the steps of:

providing a frame with left and right support members;

rigidly securing left and right brackets on respective support members;

orienting the barbell so that its longitudinal axis extends perpendicular to the support members;

resting the barbell on the brackets; and prior to securing the brackets on respective support members, configuring the brackets to engage the barbell at respective left and right locations which are radially spaced at a distance from respective support members to create a gap sufficient to accommodate a user's hands between the front of the support members and a barbell engaged by the brackets, and axially spaced from one another to a greater extent than the support members.

10. The method of claim 9, further comprising the step of configuring each of the brackets to provide multiple barbell resting positions along respective support members.

11. The method of claim 9, wherein the configuring step involves cutting notches into solid blocks of plastic to form the brackets.

12. The method of claim 9, wherein the brackets are configured to engage the barbell at respective left and right locations which are radially spaced three inches from respective support members.

* * * * *